US005857869A

United States Patent [19]

Parcel et al.

[11] Patent Number: 5,857,869

[45] Date of Patent: Jan. 12, 1999

[54] SPRING LATCH FOR USE WITH CABLE CONNECTORS

[75] Inventors: Stephen Spencer Parcel, Woodinville; Timmy Lane Hallmark, Arlington; Allen Everett Stewart, Edmonds; Robert J. Hofmann, Everett, all of Wash.

[73] Assignee: Matsushita Avionics Systems Corporation, Irvine, Calif.

[21] Appl. No.: 881,017

[22] Filed: Jun. 23, 1997

[51] Int. Cl.[6] ..... H01R 13/62

[52] U.S. Cl. ..... 439/372

[58] Field of Search ..... 439/372, 366, 439/350, 358

[56] References Cited

U.S. PATENT DOCUMENTS 1,348,970 8/1920 Thompson ..... 439/366

4,904,202 2/1990 Uchida ..... 439/372

5,190,465 3/1993 Davidge et al. ..... 439/372

*Primary Examiner*—Neil Abrams

*Assistant Examiner*—Yong Ki Kim

*Attorney, Agent, or Firm*—Lyon & Lyon LLP

[57] ABSTRACT

A spring latch for cable connectors for computers and other electronic devices. A spring member, first connector plate and second connector plate are provided. The spring member has a pair of opposing leg members, each including a coil spring section and an outwardly extending flange. The first connector plate is adapted to slideably receive the outwardly extending flanges of the opposing leg members, and the second connector plate is adapted to detachably engage the opposing leg members at a position beneath the coil spring sections of the leg members.

2 Claims, 1 Drawing Sheet

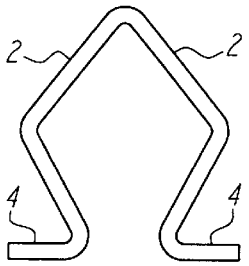
FIG. 1
(PRIOR ART)
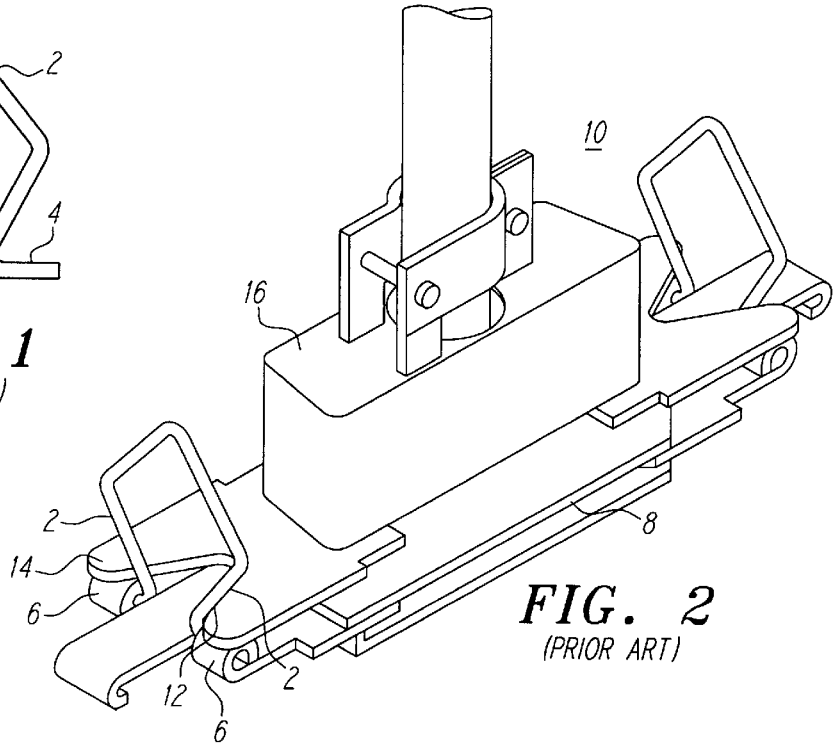
FIG. 2
(PRIOR ART)
FIG. 3
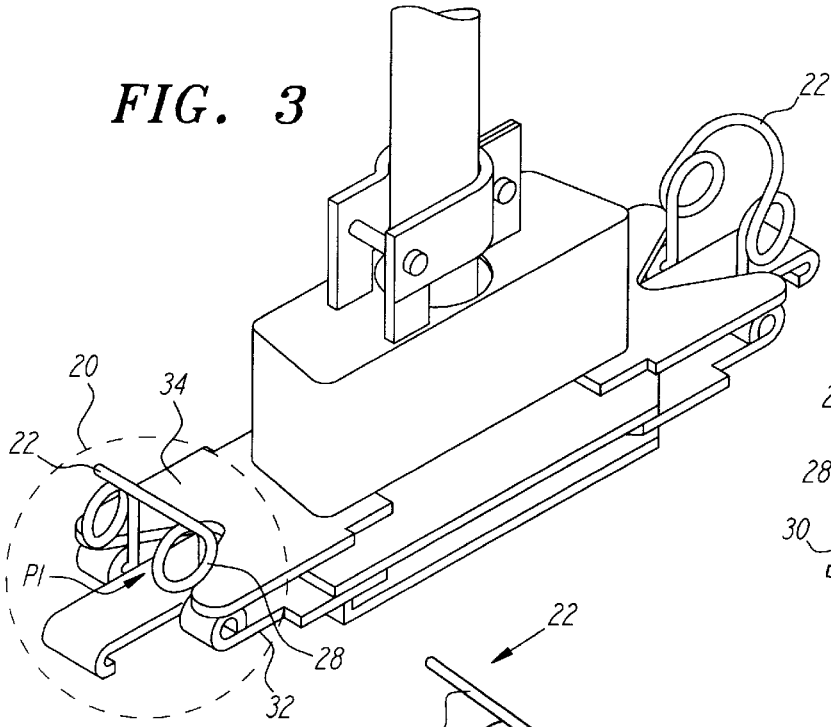
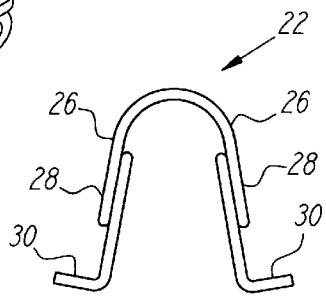
FIG. 5
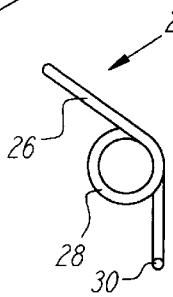
FIG. 4

SPRING LATCH FOR USE WITH CABLE CONNECTORS

FIELD OF THE INVENTION

The field of the present invention is cable connectors for computers and other electronic devices and, more particularly, spring latches for use on cable connectors.

As shown in FIGS. 1 and 2, conventional connectors for computer cables generally comprise a length of resilient wire that has been bent to form a pair of opposing leg members 2 and a pair of outwardly extending flanges 4. The outwardly extending flanges 4 are adapted to be slideably received within cylindrical sleeves 6 formed on a first portion 8 of a connector 10, and the opposing leg members 2 are adapted to detachably engage a pair of recesses 12 formed in a coupling plate 14 of a second portion 16 of the connector 10. Thus, it will be appreciated by those skilled in the art that conventional spring latches allow for the attachment and detachment of connectors without the use of tools. It will also be noted that pairs of conventional spring latches are often used to secure together mated sets of connectors.

However, it has been found that conventional spring connectors do not perform adequately in situations wherein their associated connectors may be subjected to substantial motion, vibration and/or physical handling. In short, in many circumstances conventional spring connectors do not provide for reliable connector retention. Some of the problems associated with conventional spring connectors are as follows. The spring latches on conventional connectors are often released when the connectors are rocked (or rotated) from side to side. Conventional spring latches can easily be detached or broken from their associated mounting plates, and conventional latches do not inhibit relative connector motion that is induced from vibration and physical handling. This relative motion may result in contact wear which over time results in increased contact resistance and, in some instances, contact failure.

Accordingly, it is believed that those skilled in the art would find an improved spring latch for use with computer cable connectors and other connectors to be quite useful.

SUMMARY OF THE INVENTION

The present invention is directed to the implementation and manufacture of improved spring latches for computer and other cable connectors. In one particularly innovative aspect, a spring latch in accordance with the present invention comprises a spring member having a pair of opposing leg members, each including a coil spring section and an outwardly extending flange, a first connector plate, and a second connector plate. The first connector plate is adapted to slideably receive the outwardly extending flanges of the opposing leg members, and the second connector plate is adapted to detachably engage the opposing leg members at a position beneath the coil spring sections of the leg members.

Thus, it will be appreciated that a spring latch in accordance with the present invention is capable of providing an active spring force to hold connectors in a mated position, while maintaining the ease of use of conventional connector plates. It will also be appreciated that a spring latch in accordance with the present invention is capable of maintaining reliable coupling between associated connector pairs, and minimizing relative motion between associated connector pairs, even when those associated connector pairs are subjected to aggressive rocking, lateral rotation or physical handling. Finally, it will be appreciated that, because of the improved latching performance provided by spring latches in accordance with the present invention, those latches may be used in an effort to minimize connector contact wear and to improve system(s) reliability in high vibration environments, such as on aircraft and other vehicles.

Accordingly, it is an object of the present invention to provide an improved spring latch for use with connectors for computer cables and other electronic devices.

It is a further object of the invention to provide a spring latch for a cable connector that is capable of reliably maintaining the connections of the connector even when the connector is subject to substantial rocking, rotational movement or physical handling.

Other objects and features of the present invention will become apparent from consideration of the following description taken in conjunction with the accompanying drawings.

BRIEF DESCRIPTION OF THE DRAWINGS

FIG. 1 is an illustration of a conventional spring member commonly used in computer cable connectors.

FIG. 2 is an illustration of a conventional spring latch and associated electrical connctor assembly.

FIG. 3 is an illustration of a spring latch and associated electrical connector assembly in accordance with one embodiment of the present invention.

FIG. 4 is a side view of a spring member of the spring latch illustrated in FIG. 3.

FIG. 5 is a front view of a spring member of the spring latch illustrated in FIG. 3.

DETAILED DESCRIPTION OF PREFERRED EMBODIMENTS

Turning now to the drawings, a spring latch member 22 and associated cable connector 24 in accordance with one preferred form of the present invention is shown in FIGS. 3–5. As shown in FIGS. 3–5, a spring latch 20 in accordance with the present invention comprises a spring member 22 having a pair of opposing leg members 26, each including a coil spring section 28 and an outwardly extending flange 30, a first connector plate 32, and a second connector plate 34. The first connector plate 32 is adapted to slideably receive the outwardly extending flanges 30 of the opposing leg members 26, and the second connector plate 34 is adapted to detachably engage the opposing leg members 26 at a position P1 just beneath the coil spring sections 28 of the leg members 26.

Thus, as explained above, a spring latch 20 in accordance with the present invention is capable of providing an active spring force to hold connectors in a mated position, while maintaining the ease of use of conventional connector plates. In addition, a spring latch in accordance with the present invention is capable of maintaining reliable coupling between associated connector pairs, and minimizing relative motion between associated connector pairs, even when those associated connector pairs are subjected to aggressive rocking, lateral rotation or physical handling. Finally, because of the improved latching performance provided by spring latches 20 in accordance with the present invention, those latches 20 may be used in an effort to minimize connector contact wear and to improve system(s) reliability in high vibration environments, such as on aircraft and other vehicles.

While the invention is susceptible to various modifications and alternative forms, a specific example thereof has been shown by way of example in the drawings and is herein described in detail. It should be understood, however, that the invention is not to be limited to the particular forms or methods disclosed, but to the contrary, the invention is to cover all modifications, equivalents, and alternatives falling within the spirit and scope of the appended claims.

What is claimed is:

1. A spring latch for an electronic connector comprising:

a spring member having a pair of opposing leg members joined by a common bend, said opposing leg members each including an outwardly extending flange and an active coil section;

a first connector plate adapted to slideably receive said outwardly extending flanges of said opposing leg members; and a second connector plate adapted to detachably engage said opposing leg members at a location beneath said active coil sections.

2. A spring latch for an electronic connector comprising:

a spring member having a pair of opposing leg members joined by a common bend, said opposing leg members each including an outwardly extending flange and a coil spring section;

a first connector plate having a pair of flange receiving members for receiving and slideably engaging said outwardly extending flanges of said opposing leg members; and a second connector plate having a recess formed therein for detachably engaging said opposing leg members at a position beneath said coil spring sections of said leg members.

* * * * *